United States Patent [19]

Priest et al.

[11] 4,296,763

[45] Oct. 27, 1981

[54] HAIR CONDITIONER

[75] Inventors: Clayton W. Priest, 1413 E. 19th St., Santa Ana, Calif. 92701; Edward T. Solomon, Huntington Beach, Calif.

[73] Assignee: Clayton W. Priest, Redlands, Calif.

[21] Appl. No.: 18,424

[22] Filed: Mar. 7, 1979

[51] Int. Cl.[3] ..... A45D 1/00

[52] U.S. Cl. ..... 132/7; 132/9

[58] Field of Search ..... 132/9, 49, 7; 2/68, 2/190, 192; 134/49; 150/2.3, 2.1; D2/256

[56] References Cited

U.S. PATENT DOCUMENTS

| | | | |
|---|---|---|---|
| 1,668,608 | 5/1928 | Schnell | 132/7 |
| 1,668,775 | 5/1928 | Latz | 132/7 |
| 1,935,002 | 11/1933 | White | 132/7 |
| 2,056,135 | 9/1936 | Butler | 132/7 |
| 2,094,067 | 9/1937 | Gyrath | 132/7 |
| 2,781,764 | 2/1957 | Miller | 132/9 |
| 2,858,834 | 11/1958 | Givens | 132/9 |
| 3,088,469 | 5/1963 | Berryhill et al. | 132/9 |

OTHER PUBLICATIONS

Cosmetics–Sagarin–1957–p. 579 relied upon.

*Primary Examiner*—G. E. McNeill

*Attorney, Agent, or Firm*—Bruce A. Jagger; Gene W. Arant

[57] ABSTRACT

A cap constructed of foamed synthetic polymeric material which is impregnated with a hair revitalizing oil composition is placed over the scalp portion of a human head. An oil impervious film is placed over the exterior of the cap, and heat is applied to the cap for a period of time sufficient to allow the hair revitalizing oil composition to permeate and saturate the hair.

4 Claims, 4 Drawing Figures

HAIR CONDITIONER

This invention relates to hot oil treatments for human hair.

Previously considerable difficulty had been encountered with hot oil treatments for human hair because considerable time on the part of the operator was required to give the hot oil treatment and it involved a substantial degree of care to insure that it was applied uniformly. These and other difficulties of the prior art have been overcome according to the present invention.

According to the present invention, a sheet or layer of open pored cellular synthetic polymeric foam material is contoured so that it provides a cap which generally conforms to the scalp portion of a human head. The cap serves as a pervious substrate which is impregnated with a hair revitalizing oil composition. A wide variety of hair revitalizing oil compositions are known and include those which are normally liquid at room temperature as well as those which are solid at room temperature. Those compositions which are solid at room temperature melt at the temperatures which are utilized during the hot oil treatment.

The cap is conveniently formed by cutting two generally semicircular sheets or layers of synthetic foam and adhesively adjoining their edges. The hair revitalizing oil composition is applied to the substrate carrier by conventional means including, for example, roll coating, knife coating, curtain coating, or spray coating. One preferred procedure is the use of a hot spray coating technique in which the hair oil treating compound is heated to temperatures in excess of approximately 120 degrees Fahrenheit at which temperature they become liquid. The composition is sprayed onto the synthetic foam substrate and is then allowed to cool and solidify. Solidification takes place at temperatures below approximately 110 degrees Fahrenheit. The oil composition containing substrate is then sealed in a vapor proof container so that it reaches the site of ultimate use without significant change in its composition.

The cap impregnated with the treating composition and sealed within its vapor impervious container is generally stored and transported over a period of time and under a variety of temperature and other environmental conditions. It is necessary that the foam material be inert to the ingredients in the cap so that there is no reaction between the cap and the composition which might impair the utility of the product.

In general, suitable flexible porous inert synthetic foam substrates include foam synthetic rubber, foamed polystyrene, foamed polyesters, foamed polyurethanes, and foamed polyurethane ester materials.

The hot melt hair revitalizing compositions according to the present invention generally contain known hair oils, waxes, emulsifying agents, antioxidants, essential perfume oils, stabilizers and the like. The hair oils include natural vegetable and mineral oils as well as synthetic oils. The waxes include naturally occurring or synthetic waxes. In general, the hot melt compositions include from about one to 10 weight percent of emulsifying agent or agents; from about 10 to 50 weight percent of waxes; and from about 10 to 75 weight percent of oils which may be of vegetable, animal, mineral, or synthetic origin. Antioxidants, stabilizers, perfume agents may be added as desired and usually do not constitute more than approximately 3 percent by weight of the total composition.

One suitable hot melt composition includes by weight 3 percent diglycol stearate, 3 percent glyceryl monolaurate, 29 percent polyglycol wax, 58 percent olive oil, and 7 percent lanolin. Stabilizers may be added if desired to prevent the olive oil from oxidizing and becoming rancid. Perfumes may be added if desired. The use of carbowax 4000 as the polyglycol was gives a cloud point of above 115 degrees Fahrenheit so as to result in a viscous material which will not run out of the foam material at room temperature. The diglycol stearate and glyceryl monolaurate are surfactants which act somewhat differently from one another. The oil penetrates the hair at elevated temperatures in excess of 125 degrees Fahrenheit while the waxes and emulsifying agents generally remain on the surface of the hair. When the hair is shampooed, the self emulsifying agents act on the waxes which are readily removed with the water leaving a part of the beneficial oil in the hair. The provision of a plurality of surfactants which have different characteristics permits the effective shampooing of the hair in hard waters which may contain an excess of calcium or magnesium salts. The emulsifying agents also act to cause the penetration of the oil into different hairs. The hair conditioner compositions which are suitable according to the present inventions are those which will stay in the foamed material in the cap at ambient room temperatures until they are ready for use. They release from the foam material by melting at elevated temperatures of from approximately 115 to 130 degrees Fahrenheit. They act as effective hair conditioners when maintained in contact with the hair for a period of from approximately 15 to 20 minutes at elevated temperatures. The compositions, except for residual oils left in the hair, must be completely rinsable in ordinary shampoo and with any available water without leaving a soap film or scum. In general, the cap is composed of a sheet or layer of foam material which is approximately one-eighth of an inch thick. Approximately three-quarters of an ounce of hair treating composition is applied to the cap and distributed uniformly throughout the foam on the inside of the cap. The container in which the oil impregnated cap is stored and transported is generally a plastic bag which is both vapor proof and oil proof.

The even distribution of hair revitalizing oil composition throughout the cap insures an even distribution of oil all over the hair which is to be treated. The use of the cap eliminates the labor and skill which is required to apply oil to the hair and insures that portions of the hair will not be missed in the hand application. Also, the mess which necessarily is involved in the hand application of oil is eliminated. All of the advantage of a hot oil treatment are retained.

The use of an oil impervious film over the cap when it is in place on the user's head permits conventional heating equipment such as hair dryers, hot towels and heating caps to be used to apply the necessary heat. The heat source is not contaminated by the oil because of the presence of the oil impervious film between the exterior surface of the cap and the heat source.

The accompanying drawings are submitted for the purposes of further illustrating the invention and the best contemplated mode thereof, and not for the purposes of limiting the invention.

In the drawings there is illustrated:

Figure 1:
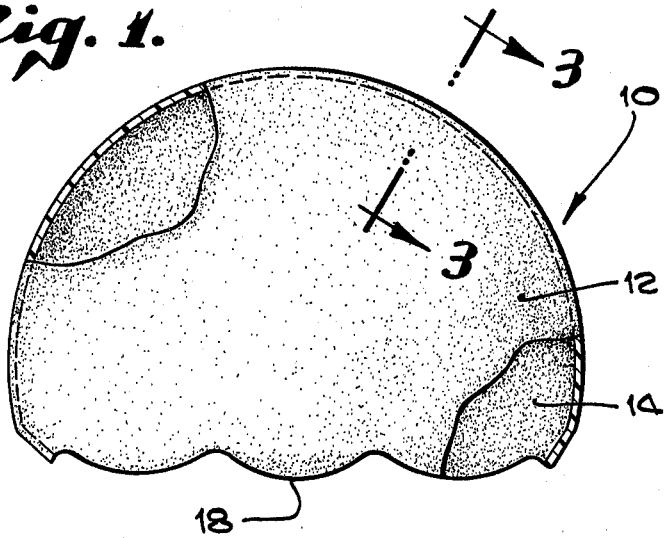
FIG. 1 is a broken side elevational view of an oil impregnated cap according to the present invention.
Figure 2:
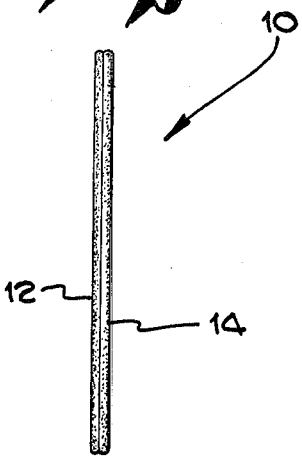
FIG. 2 is a front elevational view of the embodiment shown in FIG. 1.
Figure 4:
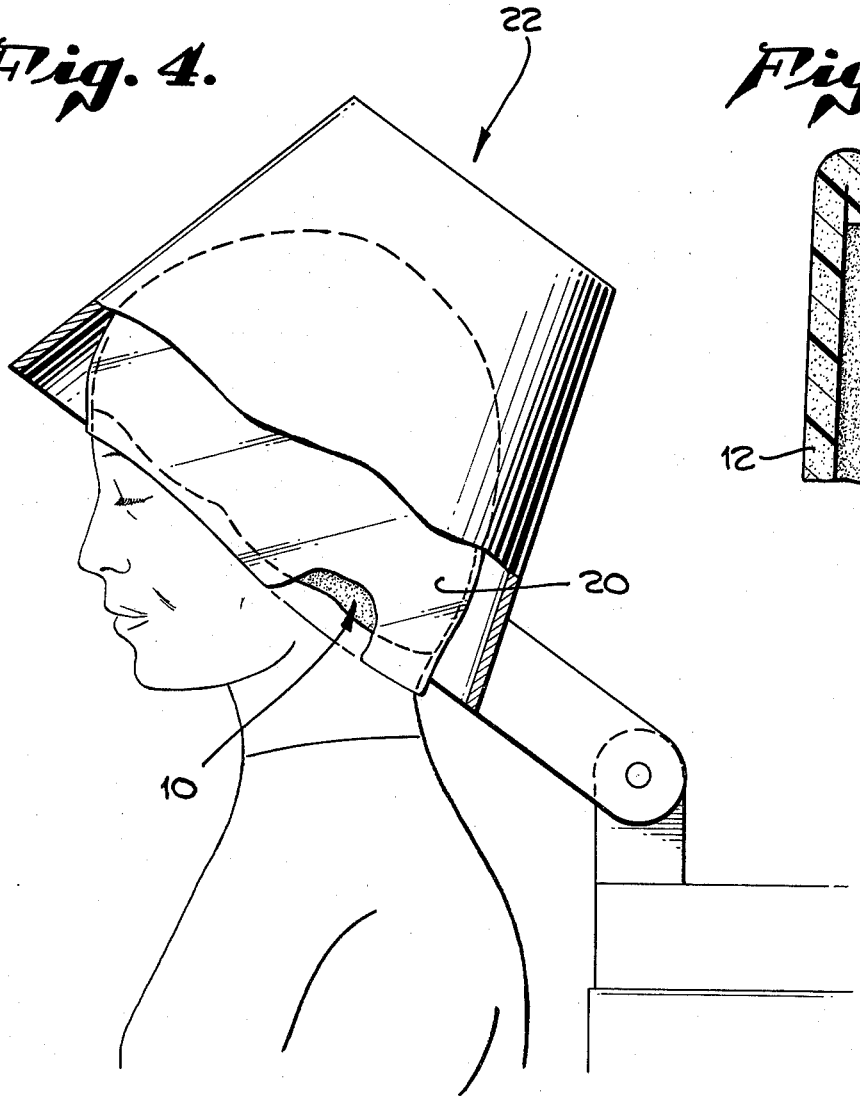
FIG. 4 is a broken side elevational view showing the cap in use.
Figure 3:
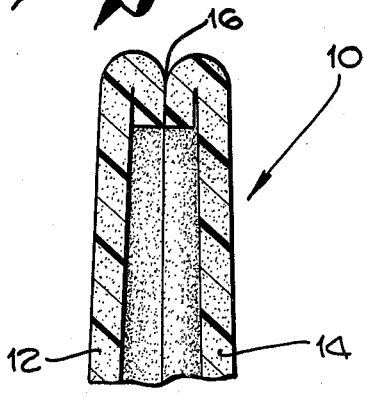
FIG. 3 is an enlarged cross-sectional view taken along line 3—3 in FIG. 1.

Referring particularly to the drawings, there is illustrated generally at 10 an oil impregnated cap composed of two flat semicircular shaped layers 12 and 14. Layers 12 and 14 are approximately one-eighth of an inch thick and are composed of open celled polyurethane foam which has been loaded with a hair revitalizing oil composition. The arcuate edges of layers 12 and 14 are rolled over and joined to one another at 16 by heat fusion. The flexible cap 10 is open along the bottom edge 18 so that the two sides can be separated and the cap slipped over the head of a user to whom the hot oil treatment is to be given. A flexible oil impervious synthetic plastic bag 20 is applied over the cap 10 so that the bag 20 covers the entire exterior surface of cap 10. A conventional hair dryer indicated generally at 22 is then positioned over the head of the wearer and heat is applied for at least approximately 15 minutes to accomplish the desired hot oil treatment. Upon the conclusion of the treatment, the cap 10 and bag 20 are removed, and hair is shampooed to remove the portion of the composition which remains on the surface of the hair. The application of hot oil to human hair according to the present invention promotes lustre, improves the hair's condition, allays irritation and softens the hair.

The revitalizing oil composition is preferably applied totally to the interior side of the cap which will be next to the hair. In this way there is a layer of foam between the oil composition and the exterior of the cap. Where some risk of oil composition seeping through the foam to the exterior of the cap can be tolerated, the bag 20 may be dispensed with.

As will be understood by those skilled in the art, what has been described are preferred embodiments in which modifications and changes may be made without departing from the spirit and scope of the accompanying claims.

What is claimed is:

1. Process of applying hot oil to human hair including:

selecting a pervious, flexible, open celled, inert synthetic foam substrate which is generally uniformly preimpregnated with a hair revitalizing oil composition and adapted to conform generally to the scalp portion of a human head, said composition being generally a solid having a melting point from about 115 to 130 degrees Fahrenheit and being substantially all retained in said preimpregnated substrate at room temperature;

placing said preimpregnated substrate in direct contact with the scalp portion of a human head;

placing an oil impervious film over substantially the entire exterior of said substrate; and applying heat at said substrate for a period of at least approximately 15 minutes to melt said composition and to release said composition from said substrate and to allow said composition to permeate said hair.

2. A product for applying hot oil to human hair comprising:

a formed sheet of pervious, flexible, open celled, inert, synthetic foam substrate generally uniformly preimpregnated with a hair revitalizing oil composition, said substrate being adapted to conform generally to the scalp portion of a human head, said composition being generally a solid and being substantially all retained in said substrate at room temperature and being heat releasable from said preimpregnated substrate; and a vapor proof container, said preimpregnated substrate being sealed in said vapor proof container.

3. Process of applying hot oil to human hair including:

selecting a pervious flexible, open celled, inert synthetic substrate which is generally uniformly preimpregnated with a hair revitalizing oil composition and adapted to conform generally to the scalp portion of a human head, said composition being generally a solid and being substantially all retained in said substrate at room temperature;

placing said preimpregnated substrate in direct contact with the scalp portion of a human head; and applying heat to said substrate for a period of time sufficient to melt said composition and to release said composition from said substrate and to allow said composition to permeate said hair.

4. A product of claim 2 wherein said foam is a polyurethane foam.

* * * * *